United States Patent [19]

Valestin

[11] 4,377,887

[45] Mar. 29, 1983

[54] STRAP AND CONNECTOR SYSTEM

[76] Inventor: James C. Valestin, 718 Briar Farm La., Kirkwood, Mo. 63122

[21] Appl. No.: 192,683

[22] Filed: Oct. 1, 1980

[51] Int. Cl.[3] ..... B65D 63/00

[52] U.S. Cl. ..... 24/206 R; 24/16 PB

[58] Field of Search ..... 24/16 PB, 17 A, 17 AP, 24/206 R, 20 EE

[56] References Cited

U.S. PATENT DOCUMENTS

| | | | |
|---|---|---|---|
| 3,107,935 | 10/1963 | Erke | 24/16 PB |
| 3,192,584 | 7/1965 | Pape | 24/16 PB |
| 3,590,442 | 7/1971 | Geisinger | 24/16 PB |
| 4,001,898 | 1/1977 | Caveney | 24/16 PB |

FOREIGN PATENT DOCUMENTS

| | | | |
|---|---|---|---|
| 1144979 | 3/1963 | Fed. Rep. of Germany | 24/16 PB |

*Primary Examiner*—Robert P. Swiatek

*Attorney, Agent, or Firm*—Kalish & Gilster

[57] ABSTRACT

A strapping system having a toothed strap and connector for engaging same. The strap is a tensible, resiliently flexible length of material with transverse teeth spaced along least end portions of the strap. The connector comprises a body having at opposite ends a pair of openings each configured for receiving a strap end portion. The body is configured for enclosing at the opposite ends at least a portion of a respective strap end including several teeth. The body defines within it a pair of resilient tooth engagement members for engaging at least one tooth of the respective strap end. The engagement members are each adapted for slidable one-way ratcheting movement relative to the teeth upon a strap end portion being received in a corresponding body end opening, thereby securely maintaining the strap ending in the end opening with the strap in tensile condition relative to the connector.

3 Claims, 4 Drawing Figures

STRAP AND CONNECTOR SYSTEM

BACKGROUND AND SUMMARY OF THE INVENTION

This invention relates to packaging and, more particularly, to a strap connector and strap system for package strapping and the like.

Heretofore, myriad arrangements have been utilized and proposed for wrapping, tying, and strapping of packages, boxes, crates, and cartons. For example, it is common practice to package containers by using steel strapping, the straps being retained by crimped metal bands and by using fiberglass strapping of comparable character. Such strapping has constituted a great improvement in packaging as compared with the ubiquitous use of wire, cord, gummed, string or filament tapes, and other age old packaging expedients.

However, metal and fiberglass strapping systems require use of special tools and techniques for proper application and tensioning which are not always available to the small commercial user or individual who wishes to take advantage of the security and tensile strength of such strap materials for packaging, tying down loads, fastening of loads, etc.

Accordingly, it is an object of the invention to provide a strapping and strap connecting arrangement, including an improved strap and strap connector system.

It is another object of the invention to provide such a system which facilitates simple, facile, manual strapping, fastening, and securement of packages and other objects.

It is a still further object of the invention to provide such an arrangement which does not require the use of special tools or techniques for applying to a package or object secure, strong, tensile strapping.

Another object of the invention is the provision of such a connector which quickly and easily engages the ends of the strap for reliably and conveniently engaging the ends of such strap.

Yet another object of the invention is the provision of such a strap and strap connector which is readily constructed entirely of molded synthetic resin material by economic, mass production techniques.

Various other objects and features will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
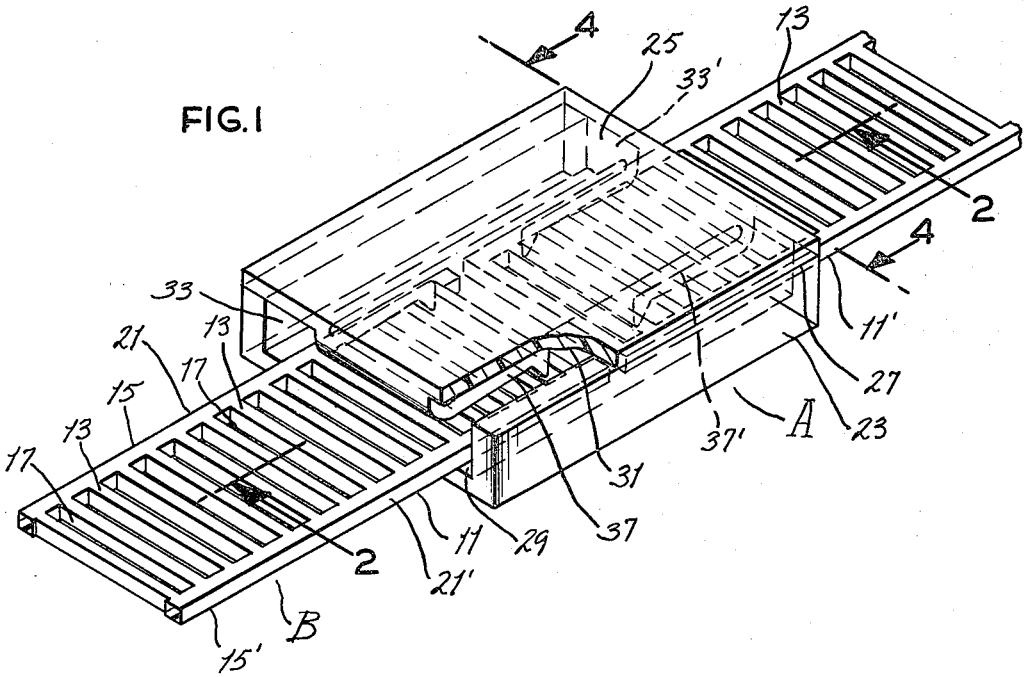
FIG. 1 is a perspective view of a strap and strap connector constructed in accordance with and embodying the present invention, a portion of the connector being shown broken away.

Referring now by reference characters to the drawings, wherein the invention is illustrated in detail, indicated at reference numeral A is a strap connector for engaging the opposite ends of a strap B, the ends being designated at 11, 11'. Although the invention contemplates the use of connector A to quickly and reliably engage said ends 11, 11' of a single strap B for maintaining the latter in a tensile condition, such as for strapping, fastening, and securement of packages or other objects, it is also contemplated that connector A may be used for interengaging opposite ends of two different straps, whether for strapping packages or merely for providing a tensile linking together of straps, regardless of the object or place of attachment of the end of such strap remote from connector A. For example, a plurality of straps of the character shown at B may each be tied down at opposite ends to a pallet, vehicle, etc. and their ends 11, 11' may be joined by engagement of connector A.

For purposes of the present description, and for simplicity, it may be assumed that ends 11, 11' are merely the opposite ends of a single strap B which extends around a package or object to be strapped or secured.

Strap B is formed of synthetic resin material such as nylon, etc. or various other polymers or copolymers capable of providing a resiliently flexible character and which is tensible, i.e., can be utilized in a tensile condition as requisite for strapping, packaging, tying, fastening, etc. Such strap B may, therefore, be readily molded or formed by conventional techniques in any desired length.

It is also preferred that connector A be formed of a resiliently flexible synthetic resin material, which also may be nylon or other material of the same or different type as strap B capable of being molded or conventionally formed by mass production techniques, being thus formed either as a single piece or as separate pieces subsequently joined as by ultrasonic welding.

Strap B is preferably formed with a plurality of evenly spaced transversely extending teeth 13 extending between opposite parallel sides 15, 15' of the strap. In transverse cross section, the strap is rectangular, being of relatively thin tape-like configuration for flexibility in the plane of the strap but resistant to bending transverse to the longitudinal axis within the plane of the sheet, while permitting some degree of torsion as may be required for conforming to packages, objects, etc. of irregular shape.

Figure 2:
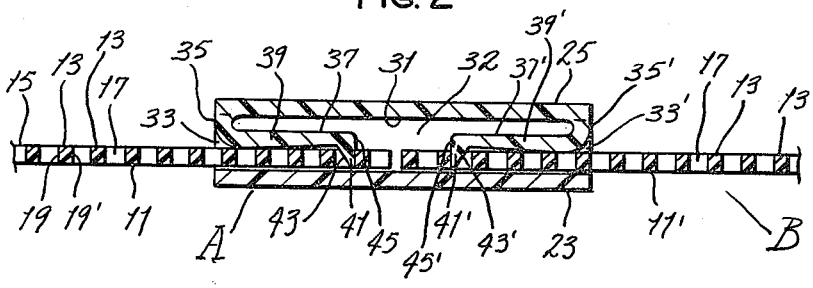
FIG. 2 is a longitudinal cross section of the strap and strap connector taken along line 2—2.

The teeth are defined by rectangular apertures 17 formed in the strap and extending between the opposite sides 15, 15'. The apertures are rectangular in plan whereby, in transverse section as viewed in FIG. 2, the strap presents said teeth 13 orthogonally and with said teeth being of rectangular, almost square cross section. The opposite faces 19, 19' of each tooth 13, thus, form a right angle to the plane of the strap. Similarly, the cross section of each of the sides 15, 15' is rectangular, presenting well-defined, squared-off side edges 21, 21'.

Connector A comprises a lower portion 23 and upper portion 25 joined to said lower portion along a line of seal 27, as by ultrasonic welding, and with both portions 23, 25 being separately molded. Said bottom portion has a U-shaped channel 29 which, with the lower surface 31 of said upper portion 25 defines a rectangular cavity 32 having openings 33, 33' at opposite ends for receiving the corresponding strap end portions 11, 11', such openings being generally rectangular but having protruding into them portions 35, 35' of tooth engagement members 37, 37' whereby said openings 33, 33', being slightly wider than strap B, are configured for slidably receiving said end portions 11, 11'.

The tooth engagement members 37, 37' are each adapted for slidable one-way ratcheting movement relative to the teeth 13 upon the respective strap end portion 11, 11' being received within its corresponding end opening 33, 33', for the purpose of securely maintaining such respective strap portion within connector A and with the strap B in tensile condition relative to the connector.

By virtue of their being secured together, portions 23, 25 are, thus, integrally joined to define a single body of connector A with said cavity 32 being rectangular.

The tooth engagement members 37, 37' each have an elongated portion 39, 39' which is integrally joined at its end 35, 35' to the upper body portion 25 in resiliently flexible relationship. At the opposite end of each such member is a respective tank which is downwardly oriented and configured for providing interdental engagement with teeth 13.

Figure 3:
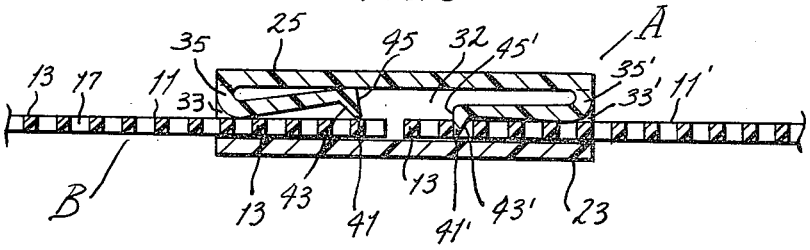
FIG. 3 is a longitudinal cross section similar to FIG. 2 illustrating a strap engaging latching member of the connector in a position assumed during insertion of one end of the strap.
Figure 4:
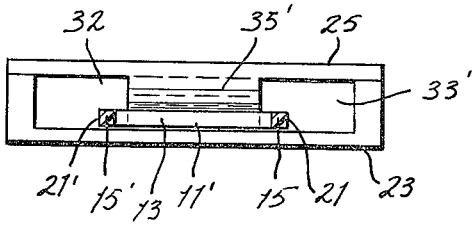
FIG. 4 is a transverse end elevation of the strap connector taken along line 4—4 of FIG. 1, and depicting the strap in cross section.

More specifically, each such tang 41, 41' has an inclined face 43, 43' for causing the tang to override the teeth of each end portion 11, 11' as it is forced into its respective opening at the end of the connector, as demonstrated in FIG. 3. Each has also a vertical face 45, 45' so as to provide confrontal, abutting contact with one of the teeth of the end portion, thereby blocking the movement of such tooth and preventing the respective end portion from being pulled from the connector when the strap is in tensile condition relative to the connector.

In use, one simply then engages one end of the strap with the connector by inserting its end portion a distance into one of the end openings 33, 33' until engaged by the corresponding tooth engagement member, as revealed by a distinct tactile ratcheting sensation and audible signal. The opposite end of the strap, which may be trimmed as necessary for providing the appropriate length whereby the strap will tightly encircle or extend around an object or package to be strapped, is then similarly inserted into the opposite end opening with similar ratcheting until the desired tensile condition of the strap is achieved.

Because of the construction of connector A, the package may be reliably shipped and handled and subjected even to abnormal abuse and roughness in handling without concern for the connector releasing the strap, providing a most reliable, secure strapping system.

Although the foregoing includes a description of the best mode contemplated for carrying out the invention, various possible modifications are possible. For example, connector A may be constructed to provide a central open portion therein so that the ends of the strap, upon being retained by engagement members 37, 37' can be observed and also grasped for further tensioning.

Further, connector A may be provided with a hinged cover, again to render the retained strap ends visible and accessible. Other modifications are also possible. For example, the lower connector member 23 may be formed such that the two strap ends are received on slightly different levels for permitting overriding relationship of one strap end with respect to the other. Further, the upper connector portion 25 may present only one tooth engagement member and the bottom portion 23 another, whereby the respective strap ends will be engaged on opposite sides with respect to one another while permitting also the strap ends to overlie one another and even to extend through and beyond the connector after insertion and engagement by the respective engagement member, thus, facilitating tightening of the strap. Another possibility is the provision of a stop member within connector A for preventing a strap end portion from being inserted beyond an appropriate or desired position.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A strapping system comprising in combination a strap and strap connector and characterized by said strap comprising a length of tensible, resiliently flexible material having a plurality of teeth spaced along at least end portions of said strap, said connector comprising a body defining at opposite ends a pair of openings each configured for receiving a strap end portion, said body being configured for enclosing at said opposite ends at least a portion of a respective strap end portion including a plurality of teeth, said body defining therewithin a pair of resilient tooth engagement members for engaging at least one tooth of the respective strap end, said engagement members each adapted for slidable one-way ratcheting movement relative to said teeth upon a strap end portion being received in a corresponding body end opening, thereby to securely maintain said strap ending in said end opening with said strap in tensible condition relative to said connector, said body comprising a first portion defining a channel having a width at least as great as that of said strap and a second portion integrally joined with said first portion to define between said first and second portions a rectangular recess, said recess opening at opposite ends of said body to define said end openings, at least one of said portions carrying from a surface thereof said pair of resilient tooth engagement members.

2. A strapping system according to claim 1 and further characterized by said tooth engagement members each comprising an elongated portion joined at one end to one of said body portions in resiliently flexible relationship and a tang at the opposite end, said tang being adapted for interdental engagement with teeth of said strap, said tang being formed for overriding teeth of said end portion upon movement thereof into the respective end opening and for blocking movement of a tooth of said end portion upon said strap being in tensile condition relative to said connector.

3. A strapping system according to claim 2 and further characterized by the first said body portion in cross section defining a U-shaped channel for receiving a pair of opposite strap end portions, the other portion of said body overlying the first said portion and carrying said resilient tooth engagement members.

* * * * *